US008099971B2

(12) United States Patent
Zamora et al.

(10) Patent No.: US 8,099,971 B2
(45) Date of Patent: Jan. 24, 2012

(54) VAPORIZATION REDUCTION CONTROL SYSTEM AND METHOD FOR A VEHICLE

(75) Inventors: Mario Miguel Zamora, Livonia, MI (US); Michael A. Turley, Dexter, MI (US)

(73) Assignee: GM Global Technology Operations LLC

( * ) Notice: Subject to any disclaimer, the term of this patent is extended or adjusted under 35 U.S.C. 154(b) by 586 days.

(21) Appl. No.: 12/029,770

(22) Filed: Feb. 12, 2008

(65) Prior Publication Data

US 2009/0151660 A1 Jun. 18, 2009

Related U.S. Application Data

(60) Provisional application No. 61/013,902, filed on Dec. 14, 2007.

(51) Int. Cl.
*F25D 17/04* (2006.01)

(52) U.S. Cl. ..... 62/186; 236/49.3; 454/75; 454/239; 454/256; 123/198 D

(58) Field of Classification Search ..... 62/186; 236/49.3; 454/75, 239, 256; 123/198 D
See application file for complete search history.

(56) References Cited

U.S. PATENT DOCUMENTS

| | | | | |
|---|---|---|---|---|
| 4,977,862 | A * | 12/1990 | Aihara et al. | 123/41.12 |
| 6,508,408 | B2 * | 1/2003 | Kelly et al. | 236/91 C |
| 6,668,917 | B1 * | 12/2003 | Zeng | 165/202 |
| 6,886,351 | B2 * | 5/2005 | Palfy et al. | 62/140 |
| 7,197,927 | B2 * | 4/2007 | Stauss et al. | 73/335.02 |
| 2001/0032470 | A1 * | 10/2001 | Remond et al. | 62/133 |
| 2006/0086113 | A1 * | 4/2006 | Errington et al. | 62/181 |
| 2009/0061753 | A1 * | 3/2009 | Yurgil et al. | 454/75 |

* cited by examiner

*Primary Examiner* — Cheryl J Tyler
*Assistant Examiner* — Paolo Gonzalez

(57) ABSTRACT

A system for controlling a fan in a vehicle comprises an ambient temperature module that generates an ambient temperature enable signal when ambient temperature is within a vaporization window. An engine component monitoring module that generates a vaporization temperature enable signal when an engine component in an engine compartment has an estimated outer surface temperature that greater than a water vaporization temperature. A vehicle speed module generates a speed enable signal when the vehicle speed is less than a first vehicle speed. A fan turn-on module that selectively turns on a fan based on the temperature enable signal, the vaporization temperature enable signal and the speed enable signal.

13 Claims, 3 Drawing Sheets

VAPORIZATION REDUCTION CONTROL SYSTEM AND METHOD FOR A VEHICLE

CROSS-REFERENCE TO RELATED APPLICATIONS

This application claims the benefit of U.S. Provisional Application No. 61/013,902, filed on Dec. 14, 2007. The disclosure of the above application is incorporated herein by reference in its entirety.

FIELD

The present disclosure relates to control systems and methods for reducing vaporization in a vehicle.

BACKGROUND

The statements in this section merely provide background information related to the present disclosure and may not constitute prior art.

Sometimes passenger vehicles may create steam. For example, rain water may enter a front grill area of the vehicle. Additionally, water may enter the vehicle during a car wash. If the vehicle is standing relatively still, the steam may exit from an engine bay via the front grill opening. Occupants of the vehicle may see the steam and incorrectly think that the vehicle is overheating. As a result, the occupants may bring the vehicle to a dealer for service despite the fact that the vehicle is operating correctly.

SUMMARY

A system for controlling a fan in a vehicle comprises an ambient temperature module that generates an ambient temperature enable signal when ambient temperature is within a vaporization window. An engine component monitoring module generates a vaporization temperature enable signal when an engine component in an engine compartment has a surface temperature that greater than a water vaporization temperature. A fan turn-on module that selectively turns on a fan based on the temperature enable signal and the vaporization temperature enable signal.

In other features, a vehicle speed module generates a speed enable signal when the vehicle speed is less than a first vehicle speed. The fan turn-on module selectively turns on the fan further based on the speed enable signal.

A method for controlling a fan in a vehicle comprises generating an ambient temperature enable signal when ambient temperature is within a vaporization window; generating a vaporization temperature enable signal when an engine component in an engine compartment has a surface temperature that greater than a water vaporization temperature; selectively turning on a fan based on the temperature enable signal and the vaporization temperature enable signal.

In other features, the method further comprises generating a speed enable signal when the vehicle speed is less than a first vehicle speed and selectively turning on the fan further based on the speed enable signal.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
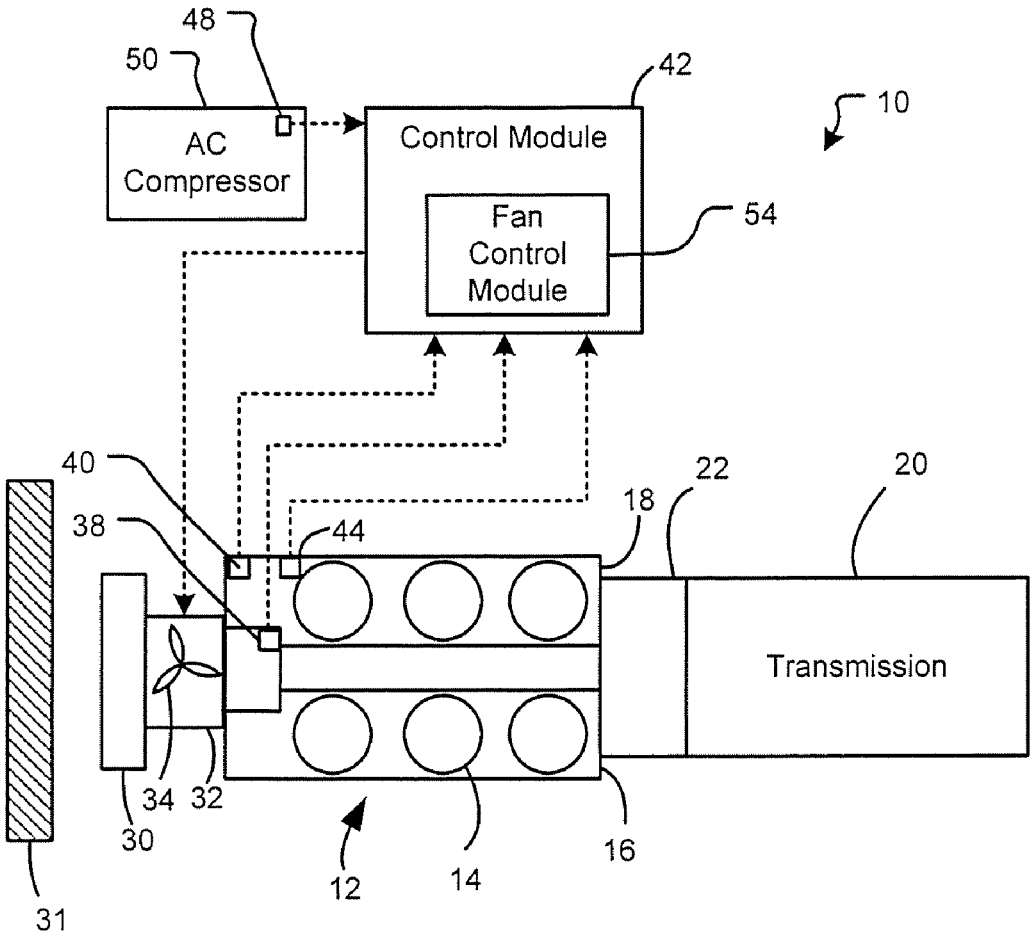
FIG. 1 is a functional block diagram of a vaporization reduction control system for a vehicle according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A vaporization reduction control system and method according to the present disclosure identifies conditions that are likely to produce steam. When the conditions are present, the present disclosure turns on a fan in an engine compartment. As a result, the fan draws the steam into the engine compartment. The steam does not exit through the front grill opening and give the appearance of an overheating condition. As a result, the occupants of the vehicle will not see steam, believe that a problem exists and bring the vehicle to a dealer for service.

Referring now to FIG. 1, a functional block diagram of an exemplary powertrain system 10 is presented. An engine 12 combusts an air-fuel mixture within one or more cylinders 14 to produce torque. In various implementations, the engine 12 includes six cylinders 14 that are configured in cylinder banks 16 and 18. Although six cylinders 14 are depicted, the engine 12 may include additional or fewer cylinders 14. For example only, the engine 12 may include 2, 4, 5, 8, 10, 12 or 16 cylinders 14. Furthermore, the cylinders 14 of the engine 12 may be configured in any suitable configuration, such as a V-configuration, an inline-configuration, and a flat-configuration.

The engine 12 transfers the torque to a transmission 20. In various implementations, the engine 12 transfers the torque to the transmission 20 via a torque converter or clutch 22. The combustion of the air-fuel mixture within the cylinders 14 generates heat. Fluid (e.g., coolant) circulates through and absorbs heat from the engine 12, thereby cooling the engine 12. The coolant extracts the heat from the engine 12 and carries the heat to a radiator 30. The coolant transfers the heat to air passing the radiator 30 by, for example, convection. In this manner, the air passing the radiator 30 cools the coolant.

Little or no air may pass the radiator 30 when the vehicle 10 is stationary or moving slowly. Accordingly, the coolant may be unable to release heat when the vehicle 10 is stationary or moving slowly. The engine 12 and/or the coolant may be damaged when the coolant is unable to sufficiently release the heat to the air passing the radiator 30.

The vehicle 10 may include a cooling fan 32 that increases airflow passing the radiator 30. Although a single cooling fan 32 is depicted, the vehicle 10 may include more than one cooling fan 32. The cooling fan 32 may be controlled by a cooling fan control signal and may be driven by an electric fan motor (EFM) 34. By increasing the airflow passing the radiator 30, the cooling fan 32 may aid in transferring the heat from the coolant to the air passing the radiator 30. The increased airflow may be especially beneficial in extracting heat from the coolant when the vehicle 10 is stationary or moving slowly.

In low temperature conditions, the coolant temperature may be sufficiently low such that the fan may be turned off while the vehicle is standing still and the engine is running. In these circumstances, steam may be produced if water enters the front grill opening and comes into contact with components in the engine compartment having a surface temperature greater then a water vaporization temperature. Water may enter the front grill area, for example only, during rain and/or when the vehicle is in a car wash. According to the present disclosure, the electric fan is turned on under certain conditions to draw air (and the steam) into the engine compartment as will be described further below.

An ambient temperature sensor 38 generates a temperature signal based upon an ambient temperature. A coolant temperature sensor 40 generates a coolant temperature signal based upon the temperature of the coolant. Although the coolant temperature sensor 40 is depicted as being located within the engine 12, the coolant temperature sensor 40 may be located anywhere that the coolant is contained, such as within the radiator 30. A pressure sensor 48 senses a high side pressure of an AC compressor 50.

A control module 42 may receive the vehicle speed signal from, for example, a vehicle speed sensor 44. The vehicle speed sensor 44 may generate the vehicle speed signal based upon any suitable measure of vehicle speed, such as engine output speed or transmission output speed.

The control module 42 receives one or more temperature signals and the coolant temperature signal, collectively referred to as input temperature signals. The control module 42 includes a fan control module 54 that generates a fan control signal based upon the input temperature signals, the ambient temperature, vehicle speed and AC high side pressure.

Figure 2:
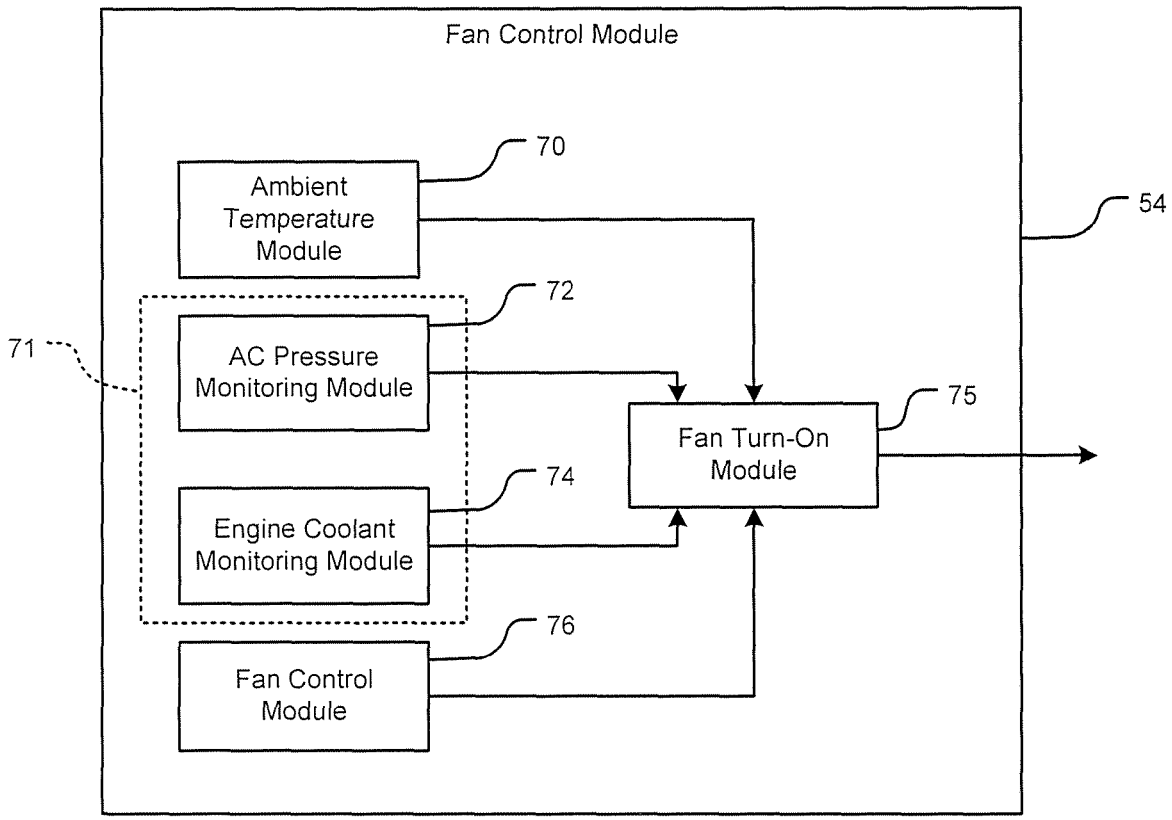
FIG. 2 is a functional block diagram of an exemplary fan control module.

Referring now to FIG. 2, an exemplary implementation of the fan control module 54 is shown in further detail. The fan control module 54 includes an ambient temperature module 70 that generates an ambient temperature enable signal when ambient temperature is within a vaporization window. An engine component monitoring module 71 generates a vaporization temperature enable signal when an engine component in an engine compartment has a surface temperature that greater than a water vaporization temperature. For example only, the engine component monitoring module 71 may estimate an outer surface temperature of components based on measured operating parameters of the component such as but not limited to internal fluid temperature, internal operating pressure, power supplied thereto, etc.

For example, the engine component monitoring module 71 may comprise an air-conditioning (AC) pressure monitoring module 72 that generates the vaporization temperature enable signal when AC pressure is greater than a first pressure and less than a second pressure. The engine component monitoring module may comprise an engine coolant module 74 that generates the vaporization temperature enable signal when an engine coolant temperature is greater than a first temperature and less than a second temperature. Alternately, both conditions may be required. Furthermore, the engine component monitoring module 71 may monitor operating parameters of components in the vicinity of the front grill opening as they are more likely to cause vaporization.

A fan turn-on module 75 selectively turns on a fan based on the temperature enable signal and the vaporization temperature enable signal. The fan turn-on module may additionally turn on the fan when the AC pressure is greater than the second pressure as may be done in conventional fan control systems. The fan turn-on module 75 may additionally turn on the fan when the engine coolant temperature is greater than the second temperature as may be done in conventional fan control systems. A vehicle speed module 76 generates a speed enable signal when the vehicle speed is less than a first vehicle speed.

Figure 3:
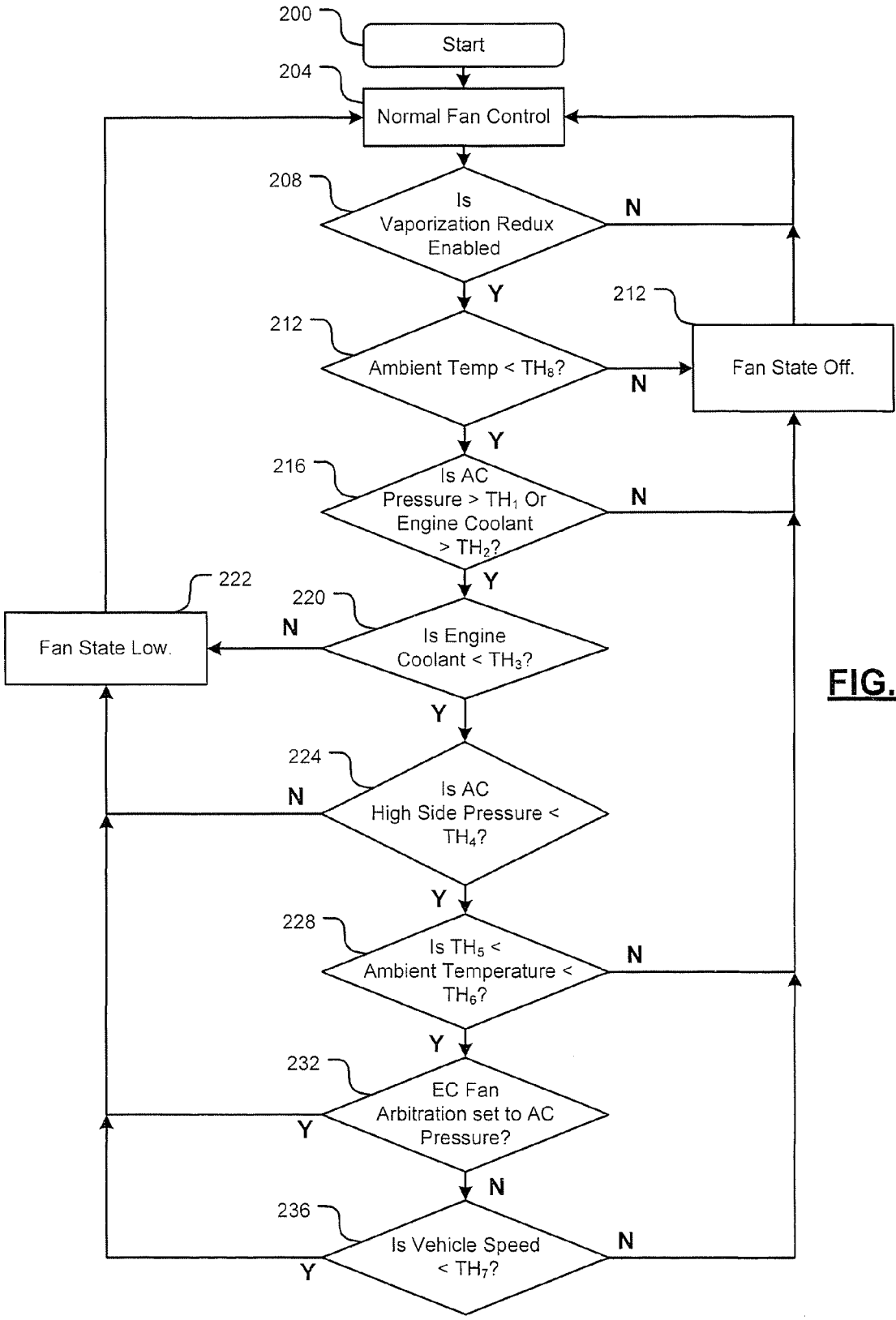
FIG. 3 is a flowchart illustrating exemplary steps of a method for reducing vaporization of water exiting through a front grill opening according to the present disclosure.

Referring now to FIG. 3, a flowchart illustrating an exemplary method for reducing vaporization is shown. The method selectively activates the vehicle electric cooling fan(s) under certain conditions in order to keep steam from being emitted from the front grill opening by drawing the air back into the engine compartment. The process has different paths to follow depending on requirements. For example only, the method illustrated in FIG. 3 may have a loop rate, such as 1 sec.

Control begins in step 200. In step 204, control is set to normal or default fan operation. Default operation involves operation of the fan in a conventional manner (without attempting to reduce vaporization). In step 208, control determines whether vaporization reduction is enabled for the vehicle. If not, control returns to step 204 and fan calibration remains in the default mode. If step 208 is true, control continues with step 212 and determines whether ambient temperature is less than an ambient temperature threshold ($TH_8$). For example only, the ambient temperature threshold may be set to a temperature approximately 10° Celsius. As used herein, "approximately" for temperature means+/−5° Celsius. For example, the ambient temperature may be set to 9.5° Celsius. If step 212 is false, control sets a fan state to off in step 212 and then control returns to step 204.

If step 212 is true, control determines whether air-conditioning (AC) high side pressure is greater than a first pressure threshold $TH_1$ or engine coolant is greater than a temperature threshold $TH_2$. For example, the temperature threshold $TH_2$ may be set to a temperature approximately 93° Celsius. For example, the first pressure threshold $TH_2$ can be set to approximately 800 kPa. As used herein, "approximately" for pressure means+/−100 kPa. These are temperature and pressure levels that may heat components in the engine compartment to the point where steam may be created under certain conditions.

If step 216 is false, control continues with step 212. If step 216 is true, control continues with step 220 and determines whether the engine coolant temperature is less than a coolant temperature threshold $TH_3$. For example only, the coolant temperature threshold $TH_3$ can be set equal to a temperature approximately 102° Celsius. If step 220 is false, control continues with step 222 and sets the fan state to a first speed. Coolant temperature $TH_3$ is typically high enough to require low speed fan operation during normal operation.

If step 220 is true, control continues with step 224 and determines whether the AC high side pressure is less than a pressure threshold $TH_4$. The pressure threshold $TH_4$ may be set equal to approximately 1300 kPa. If step 224 is false, control continues with step 222. The pressure threshold $TH_4$ may be sufficiently high to require low speed fan operation during normal operation.

If step 224 is true, control continues with step 228 and determines whether ambient temperature is greater than a temperature threshold $TH_5$ and less than a temperature threshold $TH_6$. For example only, the temperature $TH_5$ may be set to approximately 0 or 1° Celsius and the temperature threshold $TH_6$ may be set equal to approximately 9° Celsius. This temperature range corresponds to a vapor temperature window, which is the ambient temperature range where steam may be created.

If step 228 is false, control continues with step 212. If step 228 is true, control continues with step 232 and determines whether the fan is commanded on due to AC pressure or engine coolant temperature. For example only, the speed threshold may be set equal to approximately 8 kph. As used herein, "approximately" for speed means+/−5 kph. If the fan is commanded on due to AC pressure, control continues with step 222. Otherwise control continues with step 236 and determines whether vehicle speed is less than a speed threshold $TH_7$. If step 236 is true, control continues with step 222. Otherwise control continues with step 212 because the vehicle speed is high enough to draw steam into the engine compartment without the aid of the cooling fan.

What is claimed is:

1. A system for controlling a radiator fan in a vehicle comprising:

an ambient temperature module that generates an ambient temperature enable signal when ambient temperature is within a vaporization temperature range;

an engine component monitoring module that generates a vaporization temperature enable signal when:

a coolant temperature is greater than a first temperature and less than a second temperature, and an air-conditioning pressure is greater than a first pressure and less than a second pressure; and a fan turn-on module that turns on the radiator fan:

when at least one of (i) the coolant temperature is greater than the second temperature and (ii) the air-conditioning pressure is greater than the second pressure; and when (i) the ambient temperature enable signal and (ii) the vaporization temperature enable signal are generated.

2. The system of claim 1 further comprising a vehicle speed module that generates a speed enable signal to enable the fan turn-on module to turn on the radiator fan (i) when the ambient temperature enable signal and the vaporization temperature enable signal are generated and (ii) when a speed of the vehicle is less than a first vehicle speed.

3. The system of claim 1 wherein a lower temperature of the vaporization temperature range is approximately 0° Celsius and an upper temperature of the vaporization temperature range is approximately 10° Celsius.

4. The system of claim 1 wherein the first pressure is approximately 800 kPa and the second pressure is approximately 1300 kPa.

5. The system of claim 1 wherein the first temperature is approximately 93° Celsius and the second temperature is approximately 102° Celsius.

6. The system of claim 2 wherein the first vehicle speed is approximately 8 kph.

7. A method for controlling a radiator fan in a vehicle comprising:

generating an ambient temperature enable signal when ambient temperature is within a vaporization temperature range;

generating a vaporization temperature enable signal when:

a coolant temperature is greater than a first temperature and less than a second temperature, and an air-conditioning pressure is greater than a first pressure and less than a second pressure; and turning on the radiator fan:

when at least one of (i) the coolant temperature is greater than the second temperature and (ii) the air-conditioning pressure is greater than the second pressure; and when (i) the ambient temperature enable signal and (ii) the vaporization temperature enable signal are generated.

8. The method of claim 7 further comprising generating a speed enable signal to turn on the radiator fan (i) when the ambient temperature enable signal and the vaporization temperature enable signal are generated and (ii) when a speed of the vehicle is less than a first vehicle speed.

9. The method of claim 7 wherein a lower temperature of the vaporization temperature range is approximately 0° Celsius and an upper temperature of the vaporization temperature range is approximately 10° Celsius.

10. The method of claim 7 wherein the first pressure is approximately 800 kPa and the second pressure is approximately 1300 kPa.

11. The method of claim 7 wherein the first temperature is approximately 93° Celsius and the second temperature is approximately 102° Celsius.

12. The method of claim 8 wherein the first vehicle speed is approximately 8 kph.

13. A system for controlling a radiator fan in a vehicle comprising:

an ambient temperature module that determines whether ambient temperature is within a vaporization temperature range;

an engine component monitoring module that determines whether:

a coolant temperature is greater than a first temperature and less than a second temperature, and an air-conditioning pressure is greater than a first pressure and less than a second pressure; and a fan turn-on module that turns on the radiator fan:

when at least one of (i) the coolant temperature is greater than the second temperature and (ii) the air-conditioning pressure is greater than the second pressure; and when (i) the ambient temperature is within the vaporization temperature range, (ii) the coolant temperature is greater than the first temperature and less than the second temperature, and (iii) the air-conditioning pressure is greater than the first pressure and less than the second pressure.

* * * * *